US009132564B2

(12) United States Patent
Reifenhaeuser

(10) Patent No.: US 9,132,564 B2
(45) **Date of Patent: *Sep. 15, 2015**

(54) METHOD FOR CUTTING A LOAF-SHAPED FOOD USING A CUTTING MACHINE

(76) Inventor: Uwe Reifenhaeuser, Flammesfeld (DE)

( * ) Notice: Subject to any disclaimer, the term of this patent is extended or adjusted under 35 U.S.C. 154(b) by 1140 days.

This patent is subject to a terminal disclaimer.

(21) Appl. No.: 12/395,806

(22) Filed: Mar. 2, 2009

(65) Prior Publication Data

US 2010/0050834 A1 Mar. 4, 2010

(30) Foreign Application Priority Data

Feb. 29, 2008 (DE) ..... 10 2008 011 985

(51) Int. Cl.
*B26D 1/01* (2006.01)
*B26D 7/01* (2006.01)
*B26D 7/06* (2006.01)

(52) U.S. Cl.
CPC ..... *B26D 7/018* (2013.01); *B26D 7/0683* (2013.01); *B26D 2210/02* (2013.01); *Y10S 83/932* (2013.01); *Y10T 83/04* (2015.04); *Y10T 83/0538* (2015.04); *Y10T 83/654* (2015.04); *Y10T 83/6518* (2015.04); *Y10T 83/6657* (2015.04); *Y10T 83/748* (2015.04)

(58) Field of Classification Search
CPC .. B26D 7/018; B26D 7/0683; B26D 2210/02; B23B 31/30; B23B 31/302; B23B 31/307; B23Q 5/22; B25B 11/005; B25B 11/007; Y10S 83/932; Y10T 83/04; Y10T 83/0538; Y10T 83/6518; Y10T 83/654; Y10T 83/6657; Y10T 83/6659; Y10T 83/748
USPC ..... 83/409, 277, 278, 932, 42, 276, 437.2, 83/451, 719; 414/18
IPC ..... B26D 7/018, 7/0683, 2210/02
See application file for complete search history.

(56) References Cited

U.S. PATENT DOCUMENTS 2,895,739 A 7/1959 Smith
3,880,295 A 4/1975 Wyslotsky

FOREIGN PATENT DOCUMENTS

DE 100 24 913 A1 11/2001
GB 2 205 258 A 12/1988

*Primary Examiner* — Clark F Dexter
(74) *Attorney, Agent, or Firm* — Von Rohrscheidt Patents

(57) ABSTRACT

In a method for cutting a loaf-shaped food, a loaf of the food is advanced toward a cutting device by a feed apparatus and the loaf is cut into slices, strips or cubes by said cutting device, which includes that the loaf is fixed during the feed movement by a vacuum gripper that is advanced together with the loaf; a negative pressure is generated within an interior of a contact element of the vacuum gripper and acts upon a fixing region of the surface of the loaf in a suction region of the contact element, in order to prevent hygienic problems associated with vacuum pumps, the negative pressure is generated by a piston-cylinder unit, the piston of which defines the interior of the contact element.

4 Claims, 3 Drawing Sheets

METHOD FOR CUTTING A LOAF-SHAPED FOOD USING A CUTTING MACHINE

CROSS-REFERENCES TO RELATED APPLICATIONS

This application claims the priority of German Patent Application Serial No. DE 10 2008 011 985.7, filed Feb. 29, 2008 pursuant to 35 U.S.C. 119(a)-(d), the subject matter of which is incorporated herein by reference.

BACKGROUND OF THE INVENTION

The invention relates to a method for cutting food, in particular a loaf-shaped food, in which a loaf of the food is advanced toward a cutting device by means of a feed apparatus and cut into slices, strips or cubes by the cutting device.

The invention also relates to a method for cutting a loaf-shaped food, in which a loaf of the food is advanced toward a cutting device by means of a feed apparatus and cut into slices, strips or cubes by said cutting device, wherein the loaf is fixed during the feed movement by means of a vacuum gripper that is advanced together with the loaf, and wherein a negative pressure is generated within the interior of a contact element of the vacuum gripper and acts upon a fixing region of the surface of the loaf in a suction region of the contact element.

The invention furthermore pertains to a cutting machine for cutting a loaf-shaped food that makes it possible to cut a loaf of the food into slices, strips or cubes and features a feed apparatus for advancing the loaf toward the cutting device during the cutting process, wherein the feed apparatus features a vacuum gripper that makes it possible to fix the loaf during the feed movement and can be advanced toward the cutting device together with the loaf, and wherein a negative pressure can be generated within an interior of the contact element of the vacuum gripper and acts upon a fixing region of the surface of the loaf in a suction region of the contact element.

The invention also pertains to a vacuum gripper for a cutting machine for cutting a loaf-shaped food, such that the loaf of the food can be fixed by means of the vacuum gripper during a feed movement, and a negative pressure is generated within the interior of a contact element of the vacuum gripper and acts upon at least one fixing region of the surface of the loaf in at least one suction region of the contact element.

A method and a cutting machine for cutting into slices, strips or cubes are generally known. As compared with the utilization of gripping hooks, fixing the loaf by means of a vacuum gripper provides the advantage that the loaf itself remains undamaged because its surface is not permanently changed by the contact element of the vacuum gripper. In the known methods and cutting machines, the negative pressure is generated with the aid of so-called vacuum pumps. The negative pressure is transmitted from the vacuum pump to the interior of the contact element through a line. The contact element itself typically consists of a rubber collar of sorts that is intended to compensate uneven areas and irregularities on the surface of the loaf due to its elastic properties in order to thusly prevent the admission of air into the suction region of the rubber collar after the negative pressure is applied. During the cutting mode of the known machines, the vacuum pumps used typically operate continuously such that they do not have to be switched on and off between the cutting of two successive loafs, wherein the continuously operating vacuum pumps also compensate possible leaks in the region of the contact element that would allow ambient air to flow into the interior of the contact element and permanently maintain a sufficiently high negative pressure.

DE 100 24 913 A1 discloses a cutting machine of the initially cited type, the feed apparatus of which comprises at least one "suction cup" that defines a negative pressure chamber, wherein this negative pressure chamber is open toward the loaf. The suction cup features a blade-shaped edge that is intended to ensure a very tight connection between the suction cup and the product loaf.

U.S. Pat. No. 3,880,295 also describes a cutting machine featuring a suction head with six suction regions that are arranged linearly adjacent to one another and equipped with blades that dig into the face to be fixed to a product being cut. In this case, each individual suction region is formed by an annular space between an inner blade and an outer blade extending concentric thereto. No suction region is arranged within the inner blade. The annular suction region therefore is outwardly and inwardly sealed by one respective blade.

However, the continuous operation of vacuum pumps proved problematic with respect to hygienic considerations. Air continuously flows from the vacuum gripper or the fixed loaf of food into the pump via the suction line between the interior of the contact element and the vacuum pump. Depending on the consistency of the food, it is unavoidable that food particles are transported into the vacuum pump via the suction line and discharged into the surroundings, i.e., the room in which the cutting machine is situated, together with the exhaust air of the vacuum pump. Since it is hardly possible to effectively clean the suction line and the vacuum pump, the food particles transported into the suction line and the vacuum pump lead to a germinal contamination of these regions over the course of time. The germs are then released into the ambient air together with the exhaust air flow of the vacuum pump and result in an increased germinal contamination in the room in which the known cutting machines are situated. This is particularly undesirable with respect to cutting machines with fully automated packaging machines connected thereto. In the packaging of sliced foods in welded self-service foil packages, any germinal contamination is extremely undesirable because the required minimum expiration dates could otherwise not be achieved. The cutting and packaging process nowadays typically takes place in quasi clean room-like environments, in which the germinal contaminations caused by known vacuum pumps are intolerable.

It would therefore be desirable and advantageous to provide an improved method for cutting a loaf-shaped food, as well as a corresponding cutting machine in which the germinal contamination resulting from the utilization and operation of a vacuum gripper, as well as from the generation of negative pressure, is reduced. The present invention furthermore aims to make available a corresponding vacuum gripper.

SUMMARY OF THE INVENTION

According to one aspect of the present invention, a method for cutting a loaf-shaped food, as well as a corresponding cutting machine in which the negative pressure is generated by means of a piston-cylinder unit, the piston of which defines the interior of a contact element.

According to another aspect of the invention, the method for cutting a loaf-shaped food includes the steps of advancing the food toward a cutting device by means of a feed apparatus for cutting into slices, strips or cubes by said cutting device, fixing the loaf during the feed movement by means of a vacuum gripper advanced together with the loaf, wherein a negative pressure is generated within an interior of a contact element of the vacuum gripper acting upon at least one fixing region of the surface of the loaf in at least one suction region of the contact element, and generating a negative pressure by means of at least one piston-cylinder unit with the piston defining the interior of the contact element.

According to a further aspect of the invention, a cutting machine for cutting a loaf-shaped food into slices, strips or cubes includes a feed apparatus for advancing the loaf toward a cutting device during the cutting process, the feed apparatus comprising a vacuum gripper for fixing the loaf during a feed movement and for advancing the vacuum gripper toward the cutting device together with the loaf; wherein the vacuum gripper includes a contact element in whose interior a negative pressure is generated and acting upon at least one fixing region at the surface of the loaf in at least one suction region of the contact element, wherein at least one piston-cylinder unit is provided for generating the negative pressure in the interior of the contact element and wherein the piston of the at least one piston-cylinder unit defines the interior of the contact element.

In contrast to vacuum pumps according to the state of the art that typically operate continuously, a piston-cylinder unit does not produce any exhaust air during the vacuum generation because the interior of the contact element, in which the negative pressure is generated, is sealed toward the outside. Any food particles that may separate during the fixing of the loaf and penetrate into the interior of the piston-cylinder unit therefore cannot be transported into distant regions such as, for example, a vacuum pump from the piston-cylinder unit In the inventive method, it therefore suffices to clean the interior of the vacuum gripper including the piston-cylinder unit in addition to its contact element. All the food particles that may have separated must still be situated in this region and cannot be carried off into other less accessible regions.

The piston of the piston-cylinder unit preferably is displaced only once in one direction in order to generate the negative pressure and once in the opposite direction in order to neutralize the negative pressure.

According to another aspect of the invention, the piston of the piston-cylinder unit can be driven by means of an additional piston-cylinder unit, wherein the additional piston-cylinder unit itself may be driven pneumatically or hydraulically. As an alternative to the two aforementioned operating modes, it would also be possible to drive the piston of the piston-cylinder unit generating the negative pressure by means of an electric motor or an electromagnet.

With respect to the proper function of the inventive method, it is important that the suction region of the contact element is very well sealed relative to the surface of the loaf. This can be achieved, for example, by utilizing a sealing means that is approved as or for foods, for example, in the form of an oil or grease or a gel or even an emulsion of oil and water with a correspondingly high viscosity. However, it is preferred that at least one closed blade of the contact element that encloses the suction region cuts into the loaf such that a particularly reliable seal of the suction region is achieved. In the latter variation, it is preferred that the piston of the piston-cylinder unit is displaced from a starting position in the direction of a negative pressure position in order to fix the loaf and displaced from the negative pressure position beyond the starting position in the opposite direction, namely into an excess pressure position, in which an excess pressure is generated in the suction region, in order to eject the remainder, wherein the piston is displaced back into the starting position before the beginning of the next fixing process without the contact element being in sealed contact with the loaf.

This makes it possible to achieve a reliable ejection of the remainder because the retention forces that are caused, e.g., by the blade cutting into the loaf and still exist after the negative pressure is neutralized are reliably overcome due to the excess pressure such that the remainder cannot unintentionally adhere to the vacuum gripper.

Based on a cutting machine of the initially described type, the aforementioned objective is attained, according to the invention, with a piston-cylinder unit that is able to generate a negative pressure in the interior of the contact element, wherein the piston of the piston-cylinder unit defines the interior of the contact element. The inventive cutting method can be carried out in a particularly simple fashion with a machine of the above-described type.

The constructive expenditures can be minimized and the cleaning expenditures can be maintained particularly low if the piston-cylinder unit is integrated into the contact element of the vacuum gripper. The drive for the piston of the piston-cylinder unit may either consist of an additional piston-cylinder unit that may be actuated pneumatically or hydraulically or of an electric motor or an electromagnet.

With respect to the construction, it is advantageous that the piston of the additional piston-cylinder unit has the same diameter as the piston of the piston-cylinder unit for generating the negative pressure. In this case, the axes of the additional piston-cylinder unit and the piston-cylinder unit for generating the negative pressure should be aligned with one another. A common piston rod preferably extends through a partition wall between the two axially aligned piston-cylinder units in a sliding and sealed fashion.

With respect to constructive considerations, the partition wall may contain channels for realizing a medium supply to the work chambers of both piston-cylinder units, wherein respective cylinder liners are connected to both sides of the partition wall in a sealed and axially aligned fashion, namely a cylinder liner of the piston-cylinder unit for generating the negative pressure on one side and a cylinder liner of the additional piston-cylinder unit on the other side.

With respect to the vacuum gripper according to the invention, the vacuum gripper is equipped with at least one piston-cylinder unit that is able to generate a negative pressure in the interior of the contact element, wherein the at least one piston of the piston-cylinder unit defines the interior of the contact element.

The invention is described in greater detail below with reference to one embodiment of a vacuum gripper of a cutting machine that is illustrated in the drawings.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
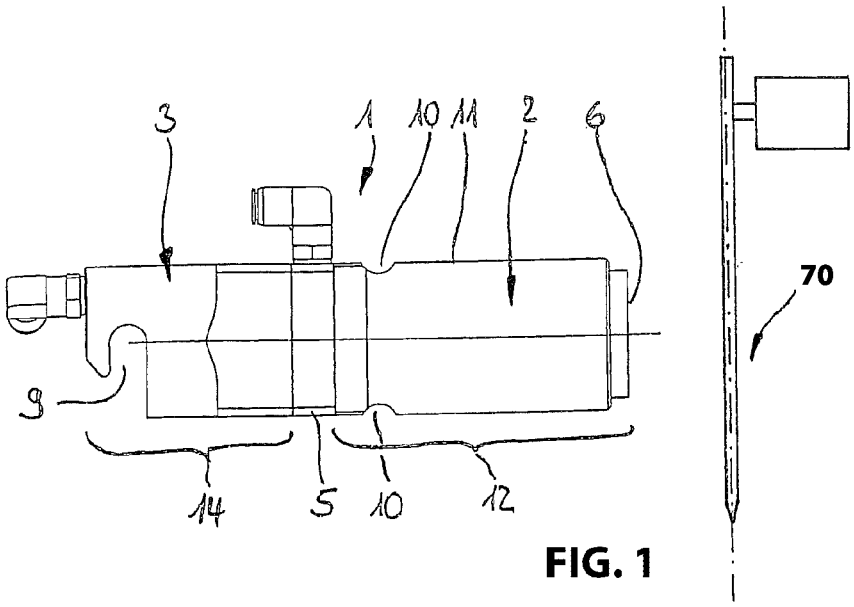
FIG. 1 is a side elevational view of a vacuum gripper according to the present invention.
Figure 2:
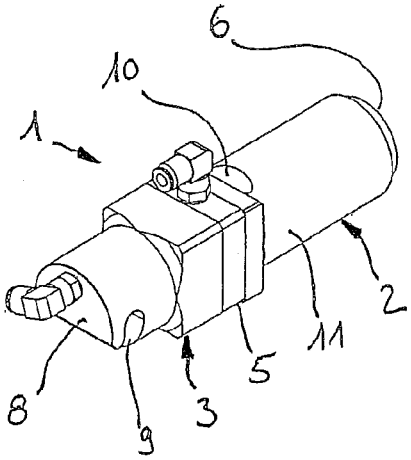
FIG. 2 is a perspective representation of the vacuum gripper according to FIG. 1 in the form of an oblique rear view.
Figure 3:
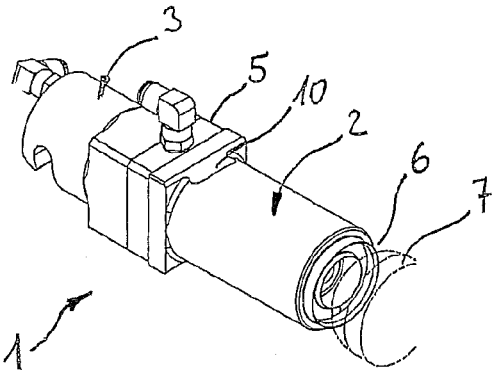
FIG. 3 is a perspective representation of the vacuum gripper according to FIG. 1 in the form of an oblique front view.
Figure 4:
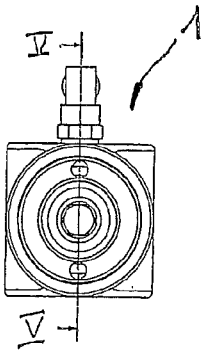
FIG. 4 is a front elevational view of the vacuum gripper according to FIGS. 1 to 3.

Throughout all the Figures, same or corresponding elements are generally indicated by same reference numerals.

Turning now to the drawing, and in particular to FIG. 1 to FIG. 5*b*, a vacuum gripper 1 illustrated in FIGS. 1 to 5*b* consists of two coaxially arranged piston-cylinder units 2 and 3 that are coupled to one another by means of a common piston rod 4 and separated from one another by a partition wall 5, in which the piston rod 4 is supported in a sliding and sealed fashion.

Figure 7:
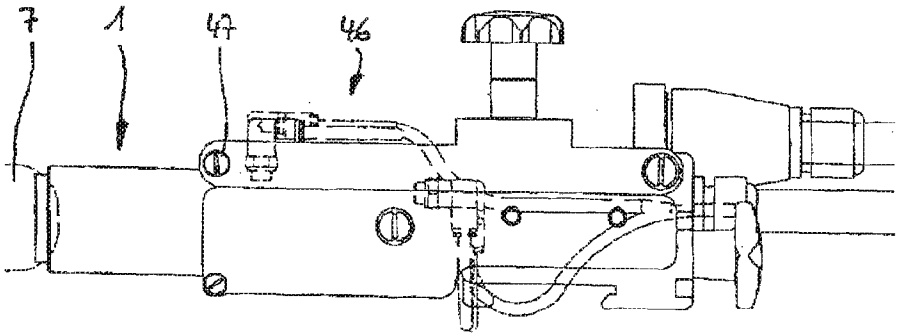
FIG. 7 is a side view of the gripping device according to FIG. 6.
Figure 8:
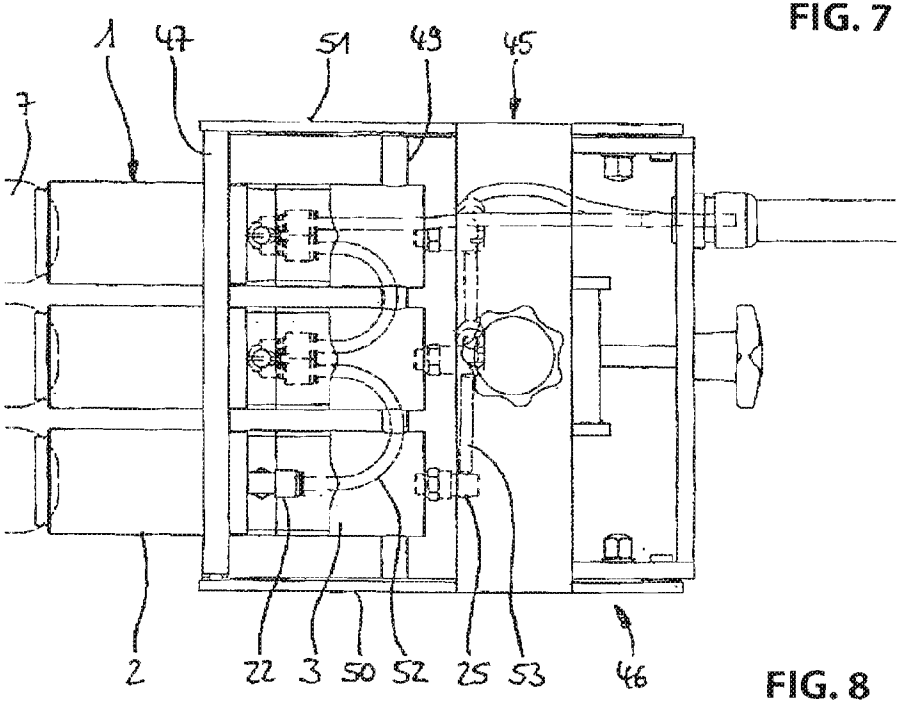
FIG. 8 is a top view of the gripping device according to FIG. 6.
Figure 6:
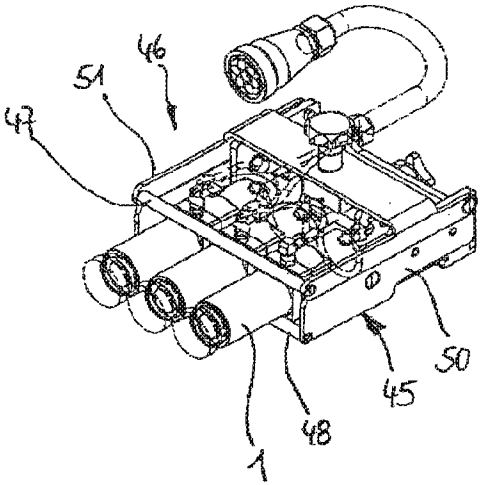
FIG. 6 is a perspective representation of a gripping device that comprises a base frame and three vacuum grippers according to FIGS. 1 to 5 supported therein.

The vacuum gripper 1 has a front side 6, on which a loaf 7, for example, in the form of a pork sausage is fixed as described in greater detail below with the aid of a negative pressure. On the opposite end, the vacuum gripper 1 has a rear side 8, on which it can be fixed on a base frame of a gripping device that is illustrated in FIGS. 6 to 8 and described in greater detail below with the aid of a slot-shaped recess 9. The mounting is furthermore achieved with two groove-shaped recesses 10 in an outside surface 11 of the vacuum gripper 1.

Adjacent to the partition wall 5, the vacuum gripper 1 features a front section 12 that is formed by the piston-cylinder unit 2 and serves for generating the negative pressure for fixing the loaf 7. The oppositely arranged rear section 14 is essentially formed by the other piston-cylinder unit 3 that serves for driving a piston 28 of the piston-cylinder unit 2 situated in the front section 12.

Figure 5A:
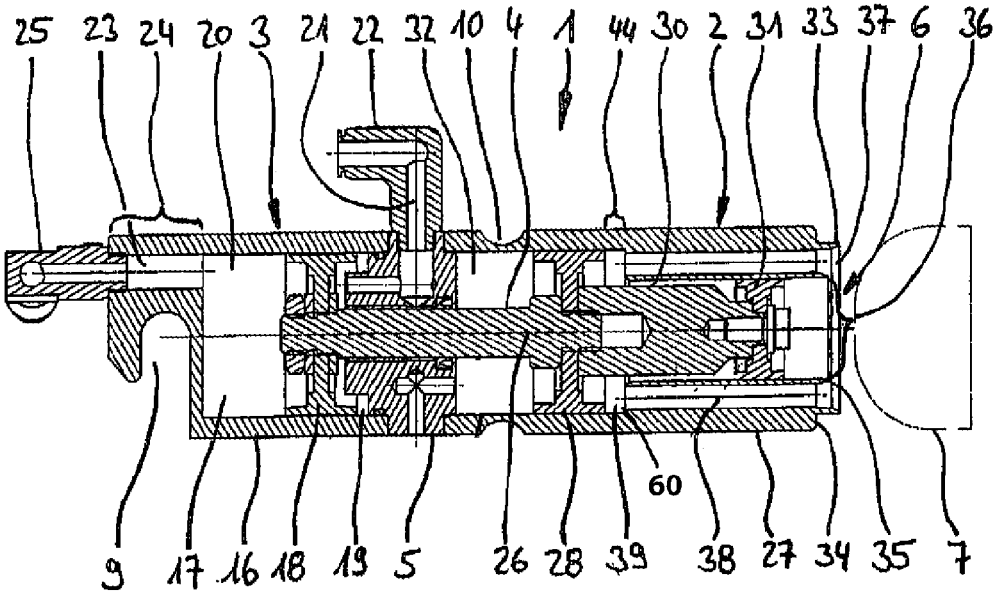
FIG. 5*a* is a longitudinal section through the vacuum gripper in a starting position along the line V-V in FIG. 4.

According to FIG. 5*a*, the piston-cylinder unit 3 that, as mentioned above, serves as the drive for generating the negative pressure consists of a cylinder liner 16 and a driving piston 18 that is supported in the interior 17 thereof in a displaceable and sealed fashion and divides the interior 17 into a first work chamber 19 that faces the partition wall 5 and a second work chamber 20 that is situated on the other side of the piston 18. The work chamber 19 can be acted upon with compressed air through a channel 21 that consists of several sections and is initially situated in a connection piece 22 inserted into the partition wall 5 and then in the partition wall 5 itself. In the partition wall 5, as well as in the connection piece 22, the channel features two sections that extend orthogonal to one another such that the complete channel 21 has the shape of a U. The second work chamber 20 is arranged in an attachment 24 of the rear section 14 via a channel 23. It also extends in a rear connection piece 25.

The piston-cylinder unit 2 that serves for generating the negative pressure for fixing the loaf 7 is situated on the opposite side of the partition wall 5 coaxial to the piston-cylinder unit 3—referred to a common axis 26. The piston-cylinder unit 2 also consists essentially of a cylinder liner 27, in which a piston 28 is supported in a sliding and sealed fashion. The piston 28 of the piston-cylinder unit 2 and the piston 18 of the piston-cylinder unit 3 have the same diameter and the same stroke due to the coupling by means of the piston rod 4.

Another piston rod 30 that leads to a piston 31 connected thereto is situated on the side of the piston 28 that lies opposite of the piston rod 4. The piston 31 is situated in a section of the cylinder liner 27 in which this liner has a reduced diameter relative to the piston 28 and a work chamber 32 corresponding thereto. The unit consisting of the pistons 28 and 31 (as well as the piston rod 30) therefore represents a stepped piston that is supported in a correspondingly stepped bore of the cylinder liner 27 in an axially displaceable fashion.

The front side 6 of the vacuum gripper 1 is provided with a closed circular outer blade 33, the wall thickness of which is significantly reduced in comparison with the remaining wall thickness of the cylinder liner 27, wherein the transition from the blade 33 to the remaining wall of the cylinder liner 27 is realized in the form of a radial step 34. The front side 6 of the vacuum gripper 1 is furthermore provided with an inner blade 35 that is also realized circularly and extends concentric to the outer blade 33. In comparison with the front edge of the outer blade 33, the front edge of the inner blade 35 is slightly set back. The inside diameter in the region of the inner blade 35 corresponds to the diameter of the front piston 31 of smaller diameter. The two blades 33 and 35 form a contact element 29 of the vacuum gripper 1 together with the cylinder liner 27.

The circular cross section formed by the inner blade 35 defines an inner partial suction region 36. The annular region that lays between the inner suction region 36 and the outer blade 33 defines an outer partial suction region 37. Both partial suction regions 36, 37 jointly form the entire effective suction region of the vacuum gripper 1. The outer partial suction region 37 is connected to a right work chamber 39 defined by the piston 28 by means of two bores 38 that are offset relative to one another by 180°.

Figure 5B:
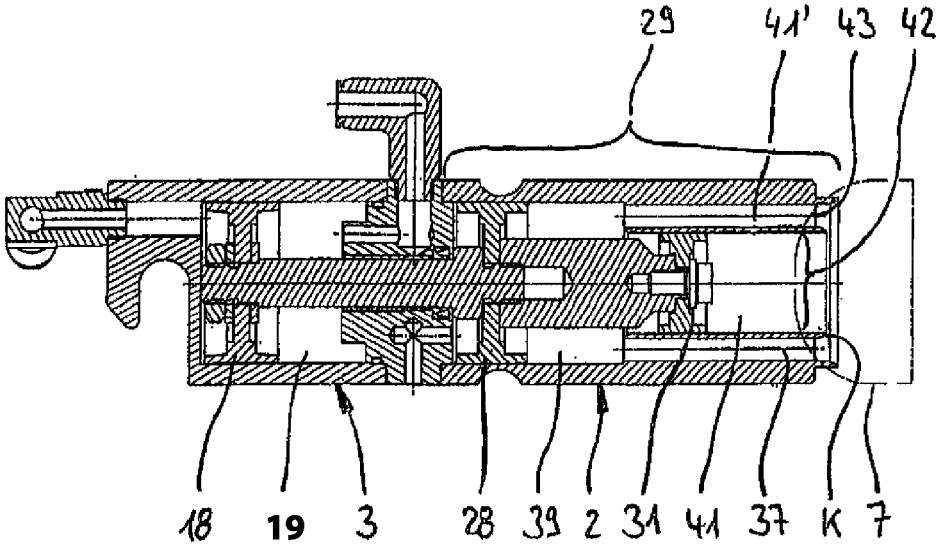
FIG. 5*b* is a representation analogous to FIG. 5*a* in a negative pressure position.

From the starting position illustrated in FIG. 5*a*, in which both blades 33 and 35 are spaced apart from the end of the loaf 7, the vacuum gripper 1 is moved toward the loaf 7, the opposite front end of which is supported on a conventional cutting device shown schematically in FIG. 1 and including, e.g., in the form of a rotatably driven cut-off knife 70. The approach of the vacuum gripper 1 takes place with a sufficiently high force and to such an extent that the both blades 33 and 35 penetrate into the loaf 7—as shown in FIG. 5*b*. Due to the rounded shape of the end of the loaf 7, the inner blade 35 penetrates deeper than the outer blade 33. The penetrating movement then becomes increasingly difficult and also stops once the loaf 7 is supported in the region of the radial step 34 of the vacuum gripper 1 with its face, wherein this is, however, not yet the case in FIG. 5*b*.

After the two blades 33 and 35 have penetrated into the material of the loaf 7 and thusly sealed the two suction regions 36 and 37, the right work chamber 19 of the piston-cylinder unit 3 is acted upon with compressed air such that the two pistons 28 and 31 are displaced toward the left into the position illustrated in FIG. 5*b*. The work chamber 39 that is situated to the right of the piston 28 and a first partial interior 41', as well as a second partial interior 41 that corresponds to the inner partial suction region 36 and is situated in the section of the cylinder liner 27 of reduced diameter, are significantly increased in this fashion such that a negative pressure is generated in the two partial suction regions 36, 37 and reliably fixes the loaf 7 on the vacuum gripper 1. The partial interiors 41, 41' are separated from one another by a contact line K formed by the inner blade 35.

Due to the very effective seal between the partial suction regions 36 and 37 produced by the blades 33 and 35, a single retraction of the pistons 28 and 31 provides for a single negative pressure generation that suffices for permanently ensuring a sufficiently high retaining force. Since the inner partial suction region 36 is completely enclosed by the outer partial suction region 37 and the pressure differential between the two regions therefore is small or ideally zero, the inner partial suction region 36, in particular, is hardly at risk of a vacuum loss. Even if air is admitted into the outer partial suction region 37 past the outer blade 33, a sufficiently high negative pressure is still maintained in the inner partial suction region 36as long as the inner blade 35 produces an adequate seal.

The inner partial suction region 36 acts upon an inner partial fixing region 42 on the surface of the loaf 7 and the outer partial suction region 37 accordingly acts upon an outer partial fixing region 43 on the surface of the loaf 7. The surfaces of both partial fixing areas 42, 43 add up to the total effective fixing region.

The negative pressures adjusting in the partial suction regions 36 and 37 after a stroke of the driving piston 18 can be influenced with the selection of the diameter of the pistons 28 and 31, the diameter of the piston rod 4 and the diameter and number of bores 38. In this case, it is sensible to choose the negative pressure being generated in the inner partial suction region 36 higher than that in the outer partial suction region 37 because the inner partial suction region 36 is arranged such that it is "protected" by the outer partial suction region 37.

After the loaf 7 has been fixed by activating the vacuum gripper, the loaf 7 can be fed to the cutting device together with the vacuum gripper 1 while slices are successively cut off the front end of the loaf 7. The feed movement is interrupted shortly before the outer blade 33 reaches the effective range of the cutoff knife of the cutting device. A reliable ejection of the remainder of the loaf 7 that still adheres to the vacuum gripper 1 is achieved in that the pistons 28 and 31 are not only retracted into the starting position illustrated in FIG. 5*a* by subjecting the work chamber 20 to pressure via the connection piece 25, but further toward the right by an additional stroke 44 (see FIG. 5*a*) until the piston 28 contacts a step 60 in the cylinder liners 27 resulting from the abrupt change in diameter. This not only causes the pressure in the two partial suction regions 36 and 37 to return to the initial level, i.e., to zero, but also a certain excess pressure to be generated in the two partial suction regions 36 and 37 that actively transports the remainder of the loaf 7 outward, wherein the friction occurring in the region of the blades 33 and 35 needs to be overcome. Subsequently, the pistons 18, 28 and 31 are returned into the starting position illustrated in FIG. 5*a* without the front side 6 of the vacuum gripper contacting a loaf 7 to be cut next in a sealing fashion, i.e., the suction regions 36 and 37 are still under atmospheric pressure. Subsequently, the next gripping and cutting cycle can begin by contacting a new loaf 7.

According to FIG. 6, three vacuum grippers 1 of the type described with reference to FIGS. 1 to 5*b* are arranged adjacent to one another in a parallel fashion in a base frame 45 of a gripping device 46. The crossbars 47 to 49 that form the base frame 45 together with lateral sections 50 and 51 fix the vacuum grippers 1 in the base frame 45 by means of the recesses 9 and 10 illustrated in FIGS. 1 to 3.

The connection pieces 25 and 22 of the respective rear piston-cylinder unit 3 that serve for actuating the front piston-cylinder units 2 for generating the negative pressure are respectively connected in parallel by means of compressed air pipes 52 and 53 such that the negative pressure for the fixing process is always simultaneously generated or neutralized for three adjacently arranged loaves 7 and the residual remains are ejected.

The base frame 45 of the gripping device 46 is known and an identical embodiment thereof serves for accommodating classic, purely mechanical grippers, in which a gripping hook penetrates into the rear end of the loaf 7 with its gripping tines due to a pneumatic actuation, wherein the gripping tines are retracted from the remainder after the cutting process is completed, namely also by means of a pneumatic actuation. Consequently, the existing base frame 45 and the compressed air connections arranged thereon can be used for the vacuum grippers 1, as well as for mechanical grippers with gripping tines that are not illustrated in the figures.

While the invention has been illustrated and described as embodied in a loaf cutting method and apparatus, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method for cutting a loaf-shaped food, comprising the steps of:

advancing a food loaf toward a cut off knife by a feed apparatus, the feed apparatus including a vacuum gripper, and the advancing of the food loaf including advancing the vacuum gripper;

cutting the food loaf into slices, strips or cubes by the cut off knife;

fixing the food loaf to the vacuum gripper during the advancing of the food loaf, wherein the fixing of the food loaf comprises generating a negative pressure within an interior of a contact element of the vacuum gripper and contacting at least one fixing region of the surface of the food loaf with at least one suction region of the contact element, wherein the negative pressure is generated by at least one piston-cylinder unit whose piston and cylinder define the interior of the contact element.

2. The method according to claim 1, wherein the generating of the negative pressure comprises displacing the piston of the at least one piston-cylinder unit only once in one direction, and further comprising releasing the food loaf by displacing the piston of the at least one piston-cylinder unit once in an opposite direction in order to neutralize the negative pressure.

3. The method according to claim 1, wherein the generating of the negative pressure comprises driving the piston of the at least one piston-cylinder unit by an additional piston-cylinder unit, and driving the additional piston-cylinder unit pneumatically or hydraulically.

4. The method according to claim 1, wherein the generating of the negative pressure comprises displacing the piston of the at least one piston-cylinder unit from a starting position and in a direction of a negative pressure position in order to fix the food loaf, and further comprising releasing the food load by displacing the piston of the at least one piston-cylinder unit from the negative pressure position beyond the starting position in an opposite direction into a positive pressure position generating a positive pressure in the at least one suction region in order to eject the remainder of the loaf from the contact element of the vacuum gripper, and displacing the piston back into the starting position before the beginning of a next fixing step without the contact element being in sealed contact with the food loaf.

* * * * *